United States Patent [19]

Burton

[11] Patent Number: 4,968,079

[45] Date of Patent: Nov. 6, 1990

[54] GOLF BALL RETRIEVER

[76] Inventor: Stanley R. Burton, 1030 Silver Rd., Ocala, Fla. 32672

[21] Appl. No.: 438,702

[22] Filed: Nov. 17, 1989

[51] Int. Cl.[5] ..... A63B 47/02

[52] U.S. Cl. ..... 294/19.2; 294/99.1

[58] Field of Search ..... 294/19.1, 19.2, 49, 294/52, 55, 55.5, 66.1, 99.1; 56/400.01, 400.04, 400.11, 400.16, 400.21, 328.1, 332; 81/53.11, 53.12; 273/32 F, 129 R, 129 K, 162 E, 162 F

[56] References Cited

U.S. PATENT DOCUMENTS

| | | | |
|---|---|---|---|
| 1,993,911 | 3/1935 | Abrams | 294/19.2 X |
| 2,538,325 | 1/1951 | Pfeiffer | 294/19.2 |
| 2,738,214 | 3/1956 | Zimmers | 294/19.2 |
| 2,935,323 | 5/1960 | Cummings | 294/19.2 X |
| 3,046,044 | 7/1962 | Christle | 294/19.2 |
| 3,306,649 | 2/1967 | Zagwyn | 204/19.2 |
| 3,442,544 | 5/1969 | Faber | 294/19.2 |
| 3,887,225 | 6/1975 | McKee | 294/19.2 |

FOREIGN PATENT DOCUMENTS

| | | | |
|---|---|---|---|
| 1380203 | 10/1964 | France | 294/19.2 |
| 501523 | 11/1954 | Italy | 294/19.2 |
| 416810 | 9/1934 | United Kingdom | 294/19.2 |

*Primary Examiner*—Johnny D. Cherry
*Attorney, Agent, or Firm*—Cumpston & Shaw

[57] ABSTRACT

A golf ball retriever comprises a basket formed from a curvilinear spine member having first and second ends, two or more curvilinear rib members, each rib member having a first rib end and a second rib end, the rib members attached to the spine member at a point approximately midway between the first and second rib ends, to form a generally spheroidal basket having an opening defined by first and second ends of the spine member, and first and second rib ends of each of the rib members, the opening having dimensions sufficient to allow a golf ball to pass therethrough, the basket being combined with a sleeve for receiving a handle.

12 Claims, 1 Drawing Sheet

FIG. 1
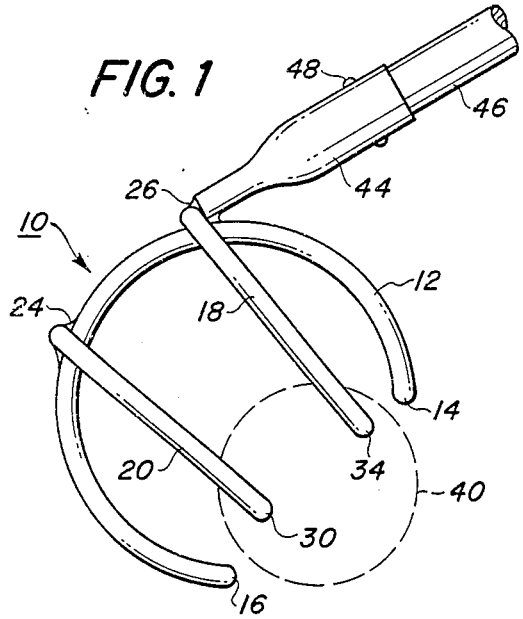
FIG. 2
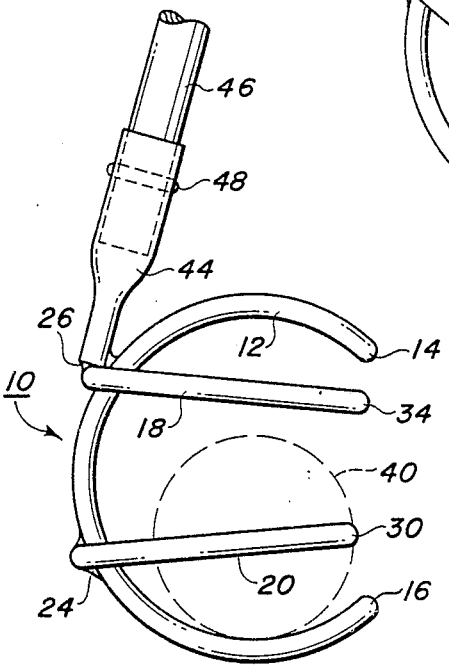
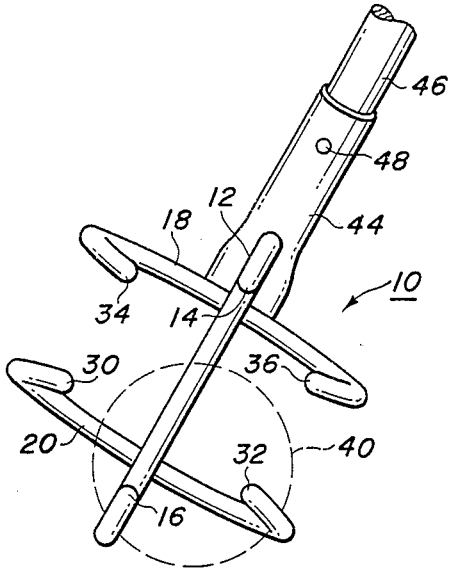
FIG. 4
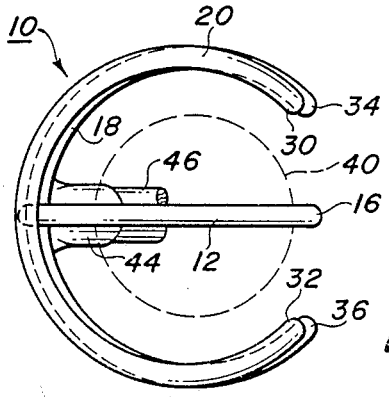
FIG. 3

GOLF BALL RETRIEVER

This invention relates generally to devices for retrieving objects and more particularly to an improved golf ball retriever.

It is an exasperating but inescapable part of golf to occasionally hit a ball into the water or some other location from which it cannot be played or easily retrieved. Over the years, the ingenuity of golfers and those who serve their needs has brought forth a succession of largely ineffective devices for assisting golfers in retrieving errant balls. Many of these devices have relied upon clever mechanisms for trapping a ball. Such mechanisms are often unreliable and sooner or later fail altogether. Balls partially buried in mud or weeds at the bottom of a pond or other water hazard are particularly difficult to retrieve. Devices that obscure the ball in the process of picking it up are particularly ill-suited to this particular problem.

It is an object of this invention to provide a simple, reliable and effective golf ball retriever. The golf ball retriever of this invention combines the advantages of being both a basket and a rake, allows mud, dirt, and water to fall out of the unit during the retrieval process, and by its open construction provides high visibility for the user. The golf ball retriever of this invention is a single piece with no complex moving mechanisms to break down or wear out.

Briefly stated, and in accordance with a presently preferred embodiment of the invention, a golf ball retriever comprises a basket formed from a curvilinear spine member having first and second ends, two or more curvilinear rib members, each rib member having a first rib end and a second rib end, the rib members attached to the spine member at a point approximately midway between the first and second rib ends, to form a generally spheroidal basket having an opening defined by first and second ends of the spine member, and first and second rib ends of each of the rib members, the opening having dimensions sufficient to allow a golf ball to pass therethrough, Preferably with about one-quarter inch clearances all around, the basket being combined with attachment means for receiving a handle.

In accordance with another aspect of this invention, the rib ends lie generally in a plane and the first spine end projects beyond the plane of the rib ends for improving the effectiveness of the golf ball retriever in picking up a golf ball.

In accordance with a further aspect of this invention, the rib and spine members define round circular arcs and the radius of the arc defined by the spine member is at least slightly larger than the radius of the arc defined by the rib members.

In accordance with a still further aspect of this invention, the basket assembly is attached to an elongated handle at an angle of about 15° relative to the handle.

While the novel aspects of the invention are defined with particularity in the appended claims, the invention itself, together with further objects and advantages thereof, may be readily understood by reference to the following detailed description of the invention taken in conjunction with the accompanying drawings in which:

FIG. 1 is a side elevation of a golf ball retriever in accordance with this invention in the Process of retrieving a golf ball (shown in phantom);

FIG. 2 is a side elevation of a golf ball retriever in accordance with this invention showing a golf ball captured therein;

FIG. 3 is an end elevation of the golf ball retriever of this invention; and

FIG. 4 is a top plan view thereof, showing the golf ball captured within the basket.

Referring now to FIGS. 1–4, a golf ball retriever indicated generally at 10 comprises a basket defined by a spine member 12 in the form of a generally circular arc, circumscribing an angle of about 270°, and preferably formed from stainless steel rods, rounded at the tips 14 and 16. First and second rib members 18 and 20 are attached to spine 12 by welds 24 and 26 to form a generally spheroidal basket. The tips 30 and 32 of rib member 20 and the tips 34 and 36 of rib member 18 generally lie on the circumference of a generally circular opening, as best seen in FIG. 4, that preferably has a diameter of about two inches, somewhat larger than the diameter of the golf ball 40 to be retrieved, shown in phantom in several figures.

In a preferred embodiment of this invention, the tips and rib and spine members clear the retrieved object by about one-quarter inch at the widest point of the object, as it passes between the tips. The tips 14 and 16 are preferably spaced apart a distance of about 2.13 inches and the tips 30 and 32, and the tips 34 and 36 are each preferably spaced apart about 1.75 inches.

An attaching sleeve 44 is attached to the basket and is adapted to receive the end of an elongated rod 46, which is preferably secured in the sleeve by a pin 48. Sleeve 44 is preferably attached to the basket assembly of the retriever by the same weld 26 that joins rib 18 to spine 12.

While those skilled in the art will recognize that the golf ball retriever shown in the several figures may be modified somewhat while continuing to accomplish the same purposes of this invention, an especially preferred embodiment of the invention relies upon a particular arrangement of the elements thereof, as more fully set forth below. Preferably, spine member 12 has a radius of 1.563″ measured to the outside surface of the element. The element itself is formed from 0.190″ diameter 304 stainless steel, as is each of the ribs 18 and 20. Preferably, the ribs form an arc having an outside diameter of 1.348″ and circumscribe an angle of 280°. Preferably, the spine member 12 is attached to sleeve 44, so that the angle defined by a line tangent to both of the tips 14 and 16 defines an angle of 15° with the longitudinal axis of the shaft. Measured from a line perpendicular to the longitudinal axis of the shaft, as viewed for example in FIG. 2, rib 18 preferably lies in a plane tilted 10° with respect to the perpendicular line, while rib 20 preferably lies in a plane tilted 20° with respect to the perpendicular line. Rib 20 is attached to spine 12 at a point lying on a line extending from the center point of the circle described by spine 12, and extending outwardly therefrom at an angle of 40° relative to the line perpendicular to the longitudinal axis of the handle. Rib 18 is attached to the spine at a point lying on a line extending from the center point of the circle defined by spine 12 at an angle of −15° relative to the longitudinal center line of the handle.

As mentioned above, the tips 14 and 16 preferably extend above the plane of the tips 30, 32, 34, and 36 of ribs 18 and 20. Preferably, tip 16 extends about 0.125″ above the plane of the rib tips.

While the invention has been described in connection with a presently preferred embodiment of the invention specifically mentioned to optimally retrieve golf balls, those skilled in the art will recognize that retrievers for other objects of different size should be scaled accordingly.

These and other changes, as will be apparent to those skilled in the art, are intended to be encompassed by the following claims.

What is claimed is:

1. A golf ball retriever having no moving parts comprising:

a curvilinear spine member having first and second free spine ends;

a plurality of curvilinear rib members, each rib member having a first free rib end and a second free rib end, said rib members attached to said spine member approximately midway between the first and second free rib ends respectively to form a generally spheroidal basket having an opening defined by the first and second free ends of said spine member and the first and second free ends of each of said rib members, said opening having dimensions sufficient to allow a golf ball to pass therethrough; and attachment means connected to one of said spine and rib members for receiving a handle.

2. A golf ball retriever of claim 1 wherein said free rib ends lie generally in a plane and said first free spine ends project beyond said plane for improving the effectiveness of the golf ball retriever in picking up a golf ball.

3. The golf ball retriever of claim 2 wherein said spine member defines a round circular arc of a first radius.

4. The golf ball retriever of claim 3 wherein each of the rib members defines a round circular arc of a second radius less than the first radius.

5. The golf ball retriever of claim 4 wherein said circular arc of the spine member subtends an angle of about 270°.

6. The golf ball retriever of claim 5 wherein the circular arc of the rib members subtends an angle of about 280°.

7. The golf ball retriever of claim 4 wherein said rib members are attached to the outside of said spine member relative to the circular area encompassed by the spine member.

8. The golf ball retriever of claim 7 in which said spine member and said rib members comprise long thin stainless steel rods.

9. The golf ball retriever of claim 8 wherein said rib members are welded to the spine member.

10. The golf ball retriever of claim 9 in which the opening defined by the free spine ends and the free rib ends is a circle having a diameter about one half inch larger than the diameter of a golf ball, thereby allowing a quarter inch clearance all around the ball for retrieval action into the basket.

11. The golf ball retriever of claim 2 in which said attachment means is attached to said spine member.

12. The golf ball retriever of claim 11 in which the attachment means is arranged to align said handle at an angle of about 15° with a line coincident with said free spine ends.

* * * * *